US009915889B2

(12) United States Patent
Soda

(10) Patent No.: US 9,915,889 B2
(45) Date of Patent: Mar. 13, 2018

(54) IMAGE FORMING APPARATUS

(71) Applicant: CANON KABUSHIKI KAISHA, Tokyo (JP)

(72) Inventor: Shota Soda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 15/153,112

(22) Filed: May 12, 2016

(65) Prior Publication Data

US 2016/0334730 A1 Nov. 17, 2016

(30) Foreign Application Priority Data

May 15, 2015 (JP) ..... 2015-100488

(51) Int. Cl.
*G03G 15/043* (2006.01)
*G03G 15/02* (2006.01)
*G03G 21/08* (2006.01)

(52) U.S. Cl.
CPC ..... *G03G 15/043* (2013.01); *G03G 15/0266* (2013.01); *G03G 21/08* (2013.01)

(58) Field of Classification Search
CPC ... G03G 15/043; G03G 15/0266; G03G 21/08
See application file for complete search history.

(56) References Cited

U.S. PATENT DOCUMENTS

2014/0003828 A1* 1/2014 Araki ..... G03G 15/0266 399/50

FOREIGN PATENT DOCUMENTS

| | | | |
|---|---|---|---|
| JP | 05-173460 | A | 7/1993 |
| JP | 07-191590 | A | 7/1995 |
| JP | 2008-122440 | A | 5/2008 |

* cited by examiner

*Primary Examiner* — David M Gray
*Assistant Examiner* — Andrew V Do
(74) *Attorney, Agent, or Firm* — Fitzpatrick, Cella, Harper & Scinto

(57) ABSTRACT

An image forming apparatus includes an intermediary transfer member, a first image forming portion including a first photosensitive member, a first charging member, a first developing device, a first transfer portion, and a first pre-exposure device, a second image forming portion including a second photosensitive member, a second charging member, a second developing device, a second transfer portion, and a second pre-exposure device, a current detecting portion, and an adjusting portion for adjusting an exposure amount of the first photosensitive member by the first pre-exposure device on the basis of a detection result of the detecting portion in a region on the first photosensitive member having contacted a toner band formed in a maximum amount per unit area on the intermediary transfer member by the second image forming portion in a state in which a transfer current is supplied.

6 Claims, 6 Drawing Sheets

IMAGE FORMING APPARATUS

FIELD OF THE INVENTION AND RELATED ART

The present invention relates to an image forming apparatus of an electrophotographic type.

Conventionally, in the image forming apparatus of the electrophotographic type, a phenomenon which is called a "ghost" such that a potential difference due to a residual charge generates at a position where a toner image is formed on a photosensitive member and an influence of the potential difference appears as an image density difference on an image particularly such as a half-tone image occurs. As a species of the ghost, a positive ghost such that the density of a currently formed image at a position corresponding to a previously formed image is thicker than the density of a peripheral portion and a negative ghost such that the density of the currently formed image at the position is thinner than the density of the peripheral portion exist.

Further, for example, in an image forming apparatus of a tandem type in which toner images are successively transferred superposedly from a plurality of photosensitive members onto an intermediary transfer member, as the species of the ghost, in addition to the above-described ghosts, the following ghost exists. That is, a phenomenon which is called a "transfer memory" such that a potential difference is generated on a photosensitive member at a downstream transfer portion by a toner transferred onto the intermediary transfer member at an upstream transfer portion occurs, and this transfer memory causes a ghost. The ghost due to the transfer memory is also called a "multi(-order)-color ghost" since multi-color toner images formed by superposing toners of a plurality of colors at a plurality of upstream transfer portions are liable to generate the potential difference on the downstream photosensitive member.

The transfer memory, which is a potential difference on the photosensitive member, causing the multi-color ghost depends on an amount per unit area of the toners transferred onto the intermediary transfer member at the upstream transfer portions and tends to worsen with an increasing toner amount per unit area. For example, in the case where image forming portions for forming toner images of yellow, magenta, cyan and black are provided, the transfer memory conspicuously appears as a density difference particularly at a cyan half-tone portion after a red solid image is formed on the intermediary transfer member at the upstream image forming portions.

Here, as a method of removing the potential difference, on the photosensitive member, causing the ghost, the following methods have been known.

First, a method in which a photosensitive member surface passing through a transfer portion is irradiated with light to remove electric charges has been known (Japanese Laid-Open Patent Application (JP-A) H07-191590). Further, a method in which an after-image is removed by applying a voltage of the same polarity as a polarity of a charge potential of a photosensitive member by an electrode provided in contact with the photosensitive member passing through a transfer portion has been known (JP-A H05-173460). Further, a method in which whether or not a ghost generates in a half-tone image is detected by measuring at least one of a surface potential difference or a toner deposition amount difference on a photosensitive member and on the basis of a detection result, an image forming condition is corrected by a correcting means has been known (JP-A 2008-122440).

However, in the method as disclosed in JP-A H05-173460, the electrode contacting the photosensitive member is used, and therefore there is a possibility that on this electrode portion, the toner which has not been completely removed is deposited and thus potential non-uniformity generates.

Further, in the method as disclosed in JP-A 2008-122440, a potential sensor for detecting the surface potential difference or a photo-sensor for detecting a toner deposition amount on the photosensitive member is used, and therefore a space and a cost for the sensor are needed.

On the other hand, in a method of removing the electric charges (discharge) of the photosensitive member by the light irradiation as disclosed in JP-A H07-191590, the discharge is effected in a non-contact secondary transfer, and a constitution of a photo-discharger (pre-exposure device) is relatively compact and inexpensive. However, in the case where the discharge is effected by the light irradiation, there is a problem such that the light irradiation more than necessary is repeated and photo-deterioration of the photosensitive member is promoted and thus a lifetime of the photosensitive member is shortened.

SUMMARY OF THE INVENTION

A principal object of the present invention is to provide an image forming apparatus capable of reducing a degree of deterioration of a photosensitive member by light irradiation when the photosensitive member is discharged by the light irradiation.

According to an aspect of the present invention, there is provided an image forming apparatus comprising: a rotatable intermediary transfer member for carrying a toner image to be transferred onto a recording material; a first image forming portion including a rotatable first photosensitive member, a first charging member for electrostatically charging the first photosensitive member, a first developing device for developing an electrostatic latent image formed on a charged surface by the first charging member, a first transfer portion for transferring a toner image onto the intermediary transfer member, and a first pre-exposure device for exposing to light the first photosensitive member at a position downstream of the first transfer portion and upstream of the first charging member with respect to a rotational direction of the first photosensitive member; a second image forming portion including a rotatable second photosensitive member, a second charging member for electrostatically charging the second photosensitive member, a second developing device for developing an electrostatic latent image formed on a charged surface by the second charging member, a second transfer portion for transferring a toner image onto the intermediary transfer member, and a second pre-exposure device for exposing to light the second photosensitive member at a position downstream of the second transfer portion and upstream of the second charging member with respect to a rotational direction of the second photosensitive member, wherein the second image forming portion is positioned upstream of the first image forming portion with respect to a movement direction of the intermediary transfer member, a detecting portion for detecting a current flowing through the first charging member when a predetermined voltage is applied to the first charging member; and an adjusting portion for adjusting an exposure amount of the first photosensitive member by the first pre-exposure device on the basis of a detection result of the detecting portion in a region on the first photosensitive member having contacted a toner band formed in a maximum amount per unit area on the intermediary transfer member by the second image forming portion in a state in which a transfer current is supplied.

Further features of the present invention will become apparent from the following description of exemplary embodiments with reference to the attached drawings.

DESCRIPTION OF THE EMBODIMENTS

An image forming apparatus according to the present invention will be described with reference to the drawings.

[Embodiment 1]

1. General Structure and Operation of Image Forming Apparatus

Figure 1:
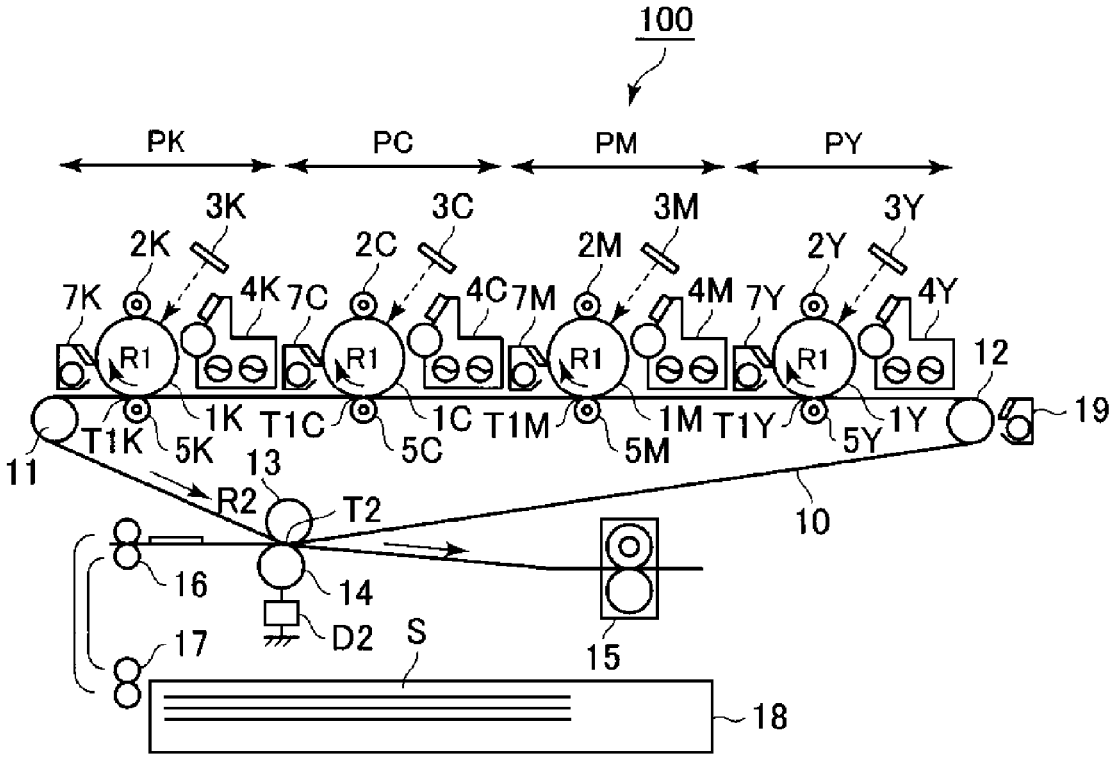
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type laser beam printer which is capable of forming a full-color image using an electrophotographic type and which employs an intermediary transfer type.

The image forming apparatus 100 includes, as a plurality of image forming portions (stations), first, second, third and fourth image forming portions PY, PM, PC and PK. The first, second, third and fourth image forming portions PY, PM, PC and PK are arranged in a line in the listed order along a rotational direction of an intermediary transfer member 10 described later and form images of yellow (Y), magenta (M), cyan (C) and black (K), respectively.

Incidentally, elements which are provided correspondingly to the image forming portions PY, PM, PC, PK and which have the same functions and constitutions, in the following, in the case where particularly distinction is not required, suffixes Y, M, C and K for representing the elements for associated colors, respectively, are omitted, and the elements will be collectively described. Further, the elements for associated colors are distinguished from each other by adding prefixes Y, M, C and K thereto in some cases.

Figure 2:
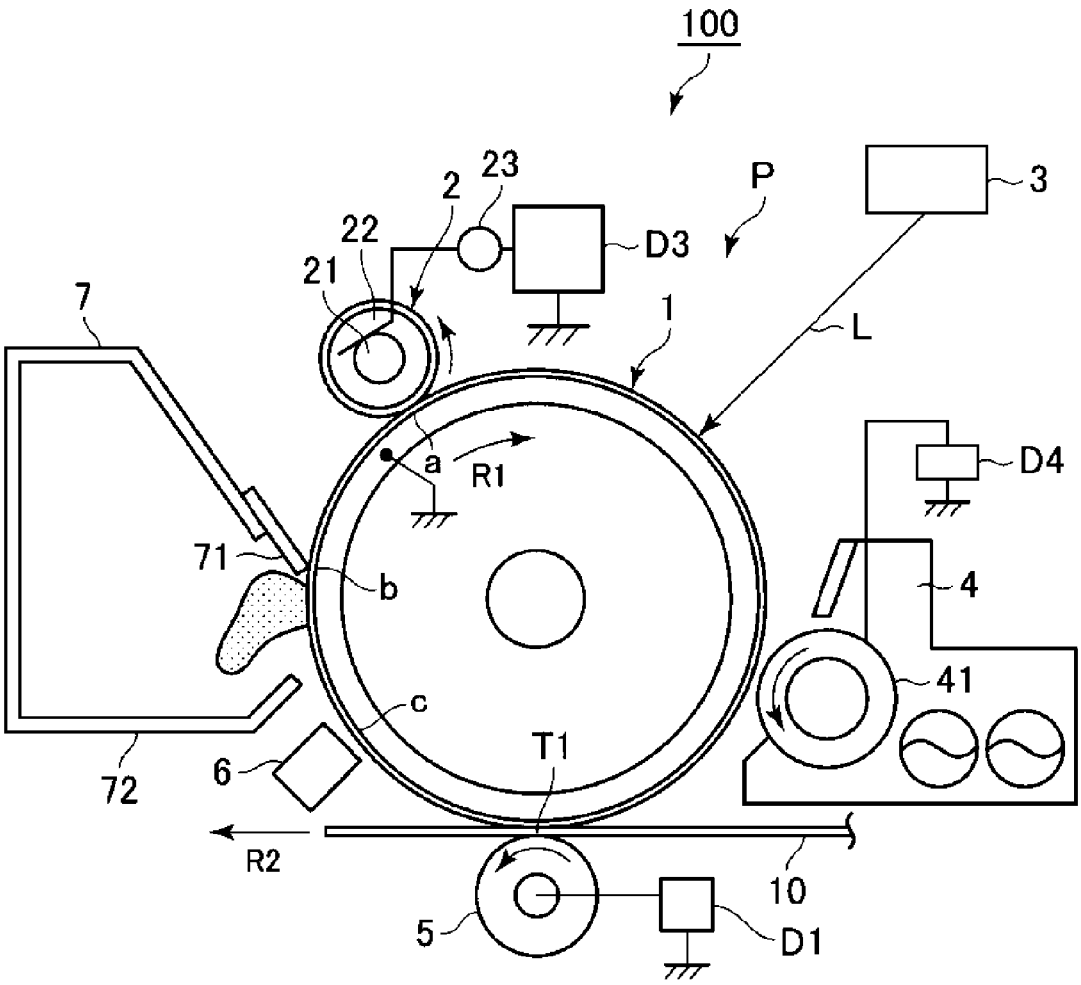
FIG. 2 is a schematic view of an image forming portion.

FIG. 2 is a schematic view specifically showing one image forming portion P as a representative. The image forming portion P includes a photosensitive member (photosensitive drum) 1 which is a rotatable drum-shaped (cylindrical) electrophotographic photosensitive member. At a periphery of the photosensitive member 1, the following process means are provided in the listed order. First, a charging roller 2 which is a roller-shaped (type) charging member as a charging means is disposed. Next, an image exposure device 3 as an image exposure means (laser scanner) is disposed. Next, a developing device 4 as a developing means is disposed. Next, a primary transfer roller 5 which is a roller-shaped (type) primary transfer member as a primary transfer means is disposed. Next, a pre-exposure device (photo-discharger) 6 is disposed. Next, a drum cleaning device 7 as a photosensitive member cleaning means is disposed.

The photosensitive member 1 which is a member-to-be-charged is an organic photosensitive member prepared by successively laminating, on an electroconductive support, a photosensitive layer of an organic substance and a surface protective layer. In the surface protective layer, fluorine-containing resin fine particles are contained. The photosensitive member 1 in this embodiment uses a 1 mm-thick aluminum plate as the electroconductive support, and thereon, the photosensitive layer and the surface protective layer are laminated, so that an outer diameter of the photosensitive member 1 is 30 mm. The photosensitive member 1 is rotationally driven about a rotation shaft at a predetermined peripheral speed in an arrow R1 direction shown in FIG. 1 by obtaining a driving force of a motor as a driving means.

The charging roller 2 as a rotatable charging member is disposed in contact with the photosensitive member 1. The charging roller 2 uses an electroconductive core metal 21 which is a shaft portion as a base material and has a structure in which an elastic layer 22 is provided on the core metal 21. As a material for the core metal 21, a metal material such as iron, copper, stainless steel or aluminum can be used, and in this embodiment, aluminum is used. Incidentally, within a range in which electroconductivity is not lost, the core metal 21 may also be subjected to plating in order to impart anticorrosive property and abrasion resistance. The elastic layer 22 is subjected to polishing so that a longitudinal central portion is thick and longitudinal end portions are thin, i.e., so as to have a so-called crown shape, in consideration of flexure during pressure application to the photosensitive member 1. This is because the longitudinal end portions of the charging roller 2 have a structure which receives a predetermined pressure toward the photosensitive member 1 by a pressing mechanism. That is, there is a tendency that a contact pressure to the photosensitive member 1 at the longitudinal central portion of the charging roller 2 is smaller than those at the longitudinal end portions, and therefore this tendency is suppressed. An electric resistance of the elastic layer 22 is adjusted so that a volume resistivity is less than $10^{10}$ Ωcm by dispersing carbon black as an electroconductive agent into a rubber (EPDM (ethylene-propylene-diene-rubber)) which is an elastic material. As the electroconductive agent, those of an electron-conductive type such as an electroconductive metal oxide or those of an ion-conductive type such as an alkali metal salt may also be used. Further, as an elastic material, synthetic rubbers such as natural rubber, SBR, silicone rubber, urethane rubber, epichlorohydrin rubber, IR, BR, NBR and CR and resin materials such as polyamide resin, polyurethane resin and silicone resin may also be used. In the charging roller 2 in this embodiment, a core metal of 8 mm in diameter is used as the electroconductive core metal 21, and the charging roller 2 is adjusted so as to have a volume resistivity of $1\times10^{6}$ Ωcm by adding an electroconductive agent in the elastic layer 22, so that an outer diameter of the charging roller 2 is 14 mm. Further, the charging roller 2 is pressed toward the photosensitive member 1 so as to have a predetermined contact pressure. Further, the charging roller 2 is rotated by rotation of the photosensitive member 1. Incidentally, the charging roller 2 may also be driven using a motor or a gear.

With the charging roller 2, a charging voltage source (high-voltage source) D3 as a charging bias application means is connected to the core metal 21. In this embodiment, between the charging voltage source D3 and the charging roller 2, an ammeter (current detecting circuit) 23 as a detecting portion for detecting a current flowing through the charging roller 2 when the charging voltage source D3 applies the voltage to the charging roller 2 is connected. In this embodiment, the charging voltage source D3 applies, to the charging roller 2, as a charging bias, an oscillating voltage in the form of a DC voltage biased with an AC voltage. In this embodiment, the charging bias is the oscillating voltage in the form of the DC voltage of −600 V biased with the AC voltage of 1700 V as a peak-to-peak voltage. In this embodiment, the ammeter 23 is capable of detecting particularly a DC current component (hereinafter simply referred to as a "charging current") in a time-resolved manner (i.e., capable of detecting a DC current component with respect to a time axis (base). Here, a time resolution may desirably be 5 msec at the minimum, particularly not more than 1 msec.

Figure 3:
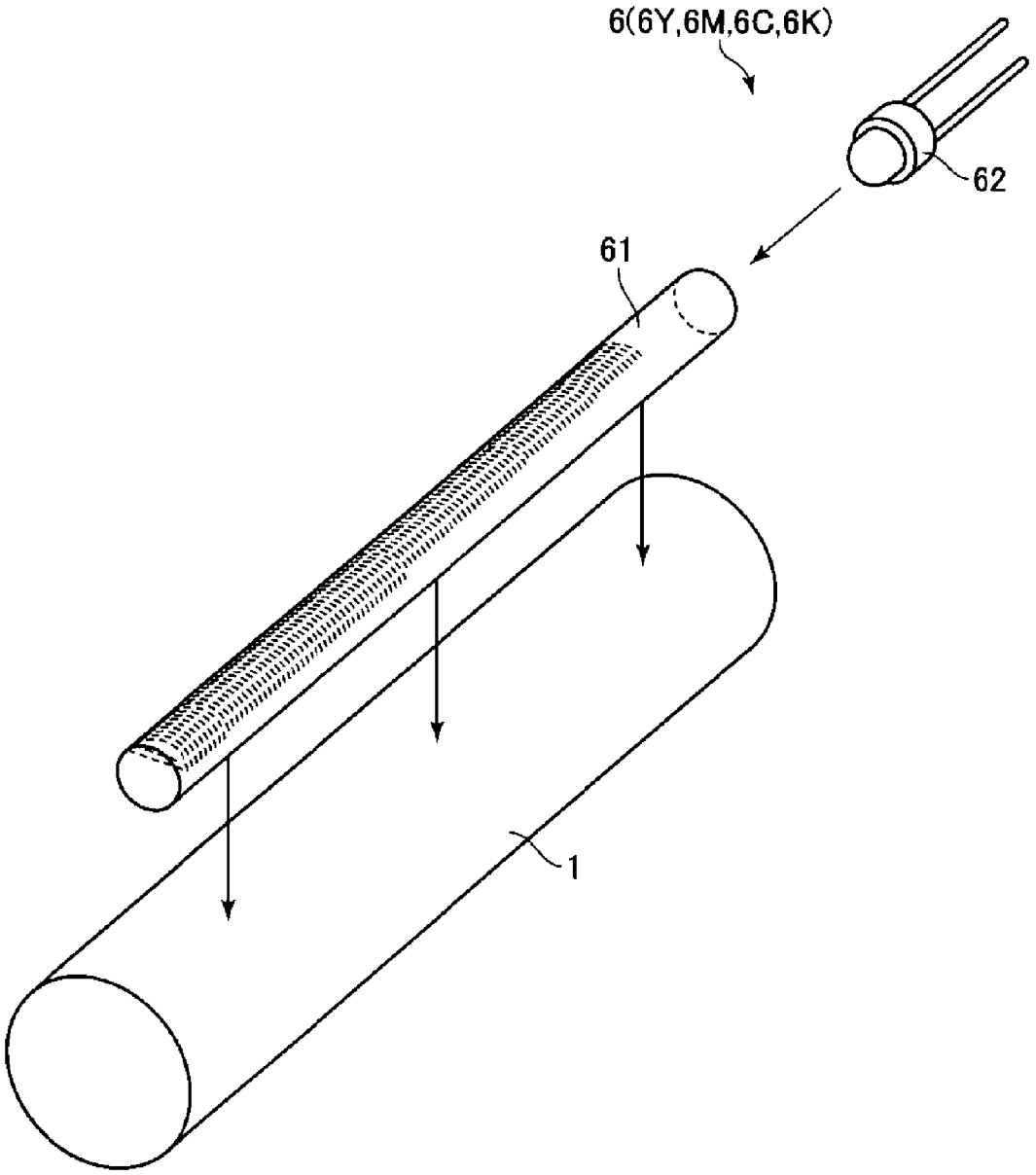
FIG. 3 is a schematic view of a pre-exposure device.

The pre-exposure device 6 is an irradiation means (photo-discharging means) for irradiating the photosensitive member 1 with light and is an example of the discharging means for removing at least a part of electric charges on the photosensitive member 1. As shown in FIG. 3, the pre-exposure device 6 includes a light guide 61 which is a light-guiding member disposed opposed to the photosensitive member 1 along a longitudinal direction of the photosensitive member 1 and an LED lamp 62 as a light source disposed at a longitudinal end portion of the light guide 61. The pre-exposure device 6 emits light from the LED lamp 62 and irradiates the photosensitive member 1 with the light reflected by a side surface of the light guide 61 (hereinafter also referred to as "pre-exposure"), so that the pre-exposure device 6 removes at least a part of the surface potential of the photosensitive member 1. As a material for the light guide 61, a resin material (acrylic resin, polycarbonate, polystyrene or the like) or glass which is excellent in light transmittance is used. In this embodiment, a single LED lamp 62 is provided at a position opposing one longitudinal end portion of the light guide 61, but in the case where a light quantity is insufficient, two LED lamps 62 in total may also be provided at positions opposing both end portions, respectively, of the light guide 61. As described later, an exposure amount of the photosensitive member 1 by the pre-exposure device 6 can be changed. Here, the exposure amount is defined as a light quantity per unit time of the light with which the surface (per unit area) of the photosensitive member 1 is irradiated.

Further, the image forming apparatus 100 includes an intermediary transfer member (intermediary transfer belt) 10 constituted by an endless belt so as to oppose the photosensitive members 1 of all of the image forming portions P. The intermediary transfer member 10 is an example of a movable transfer member onto which the toner images are transferred from the photosensitive member 1. The intermediary transfer member 10 is stretched by, as a plurality of stretching rollers (supporting rollers), a driving roller 11, a tension roller 12, and a secondary transfer opposite roller 13. In this embodiment, the intermediary transfer member 10 is formed of a polyimide-based resin, and an electrical resistance thereof is adjusted by adding an anti-static agent such as carbon black in an appropriate amount in the polyamide-based resin. The intermediary transfer member 10 is circulated and moved (rotated) at a predetermined peripheral speed in an arrow R2 direction by transmission of a driving force to the driving roller 11.

In an inner peripheral (back) surface side of the intermediary transfer member 10, the primary transfer rollers 5Y, 5M, 5C, 5K are disposed correspondingly to the photosensitive members 1Y, 1M, 1C, 1K, respectively. Each of the primary transfer rollers 5 is an example of a supplying means for supplying a transfer current for transfer between the photosensitive member 1 and the transfer member 10. The primary transfer roller 5 is urged (pressed) against the intermediary transfer member 10 toward the photosensitive member 1. As a result, the primary transfer roller 5 sandwiches the intermediary transfer member 10 between itself and the photosensitive member 1, so that a primary transfer portion (primary transfer nip) T1 which is a contact portion between the photosensitive member 1 and the intermediary transfer member 10 is formed. With the primary transfer roller 5, a primary transfer voltage source D1 as a primary transfer bias application means is connected. The primary transfer voltage source D1 applies, to the primary transfer roller 5, as a primary transfer bias, a DC voltage of an opposite polarity to a charge polarity (normal charge polarity) of the toner during development. In this embodiment, a constant-voltage type in which the primary transfer bias is subjected to constant-voltage control during the primary transfer is employed.

In an outer peripheral (front) surface side of the intermediary transfer member 10 at a position opposing the secondary transfer opposite roller 13, a secondary transfer roller 14 which is a roller-shaped (type) secondary transfer member as a secondary transfer means is disposed. The secondary transfer roller 14 is urged (pressed) against the intermediary transfer member 10 toward the secondary transfer opposite roller 13. As a result, the secondary transfer roller 14, sandwiches the intermediary transfer member 10 between itself and the secondary transfer opposite roller 13, so that a secondary transfer portion (secondary transfer nip) T2 which is a contact portion between the intermediary transfer member 10 and the secondary transfer opposite roller 13 is formed. With the secondary transfer roller 14, a secondary transfer voltage source D1 as a secondary transfer bias application means is connected. The secondary transfer voltage source D2 applies, to the secondary transfer roller 14, as a secondary transfer bias, a DC voltage of an opposite polarity to the normal charge polarity of the toner.

Further, in the outer peripheral surface side of the intermediary transfer member 10, at a position opposing the tension roller 12, an intermediary transfer member cleaning device 19 as an intermediary transfer member cleaning means is disposed.

Further, the image forming apparatus 100 includes a feeding (conveying) device for feeding a recording material S such as a recording sheet (paper) to the secondary transfer portion T2, and a fixing device 15 for fixing the toner images on the recording material S, and so on.

During image formation, the surface of the rotating photosensitive member 1 is electrically charged to a predetermined polarity (negative in this embodiment) and a predetermined potential substantially uniformly by the charging roller 2 to which the charging bias is applied. With respect to the rotational direction of the photosensitive member 1, a position, on the photosensitive member 1, when the photosensitive member 1 is charged by the charging roller 2 is a charging position (charging portion) a. Incidentally, with respect to the rotational direction of the photosensitive member 1, in an upstream side and a downstream side of the contact portion between the photosensitive member 1 and the charging roller 2, a minute gap between the photosensitive member 1 and the charging roller 2 is formed. The charging roller 2 charges the surface of the photosensitive member 1 by electric discharge generating in at least one of the upstream gap and the downstream gap. However, for convenience, the contact portion between the photosensitive member 1 and the charging roller 2 is regarded as the charging position (charging portion) a and description will be made in some cases.

The charged surface of the photosensitive member 1 is subjected to image exposure (scanning exposure) with laser light based on image information by the image exposure device 3, so that an electrostatic latent image (electrostatic image) is formed. The electrostatic latent image formed on the photosensitive member 1 is developed (visualized) as the toner image with the toner as a developer by the developing device 4. The developing device 4 includes a developing roller 41 as a developer carrying member for feeding the toner to an opposing portion to the photosensitive member 1 while carrying the toner. During the development, to the developing roller 41, an oscillating voltage in the form of a DC voltage biased with an AC voltage is applied as a developing bias from a developing voltage source D4 as a developing bias application means. In this embodiment, the toner image is formed by image portion exposure and reverse development. That is, on an exposed portion, on the photosensitive member 1, lowered in absolute value of the potential by the exposure after the photosensitive member 1 is charged substantially uniformly, the toner charged to the same polarity as the charge polarity of the photosensitive member 1 is deposited. In this embodiment, by the exposure device 3 and the developing device 4, a toner image forming means for forming the toner image on the photosensitive member charged by the charging member is constituted.

The toner image formed on the photosensitive member 1 is transferred (primary-transferred) at the primary transfer portion T1 by the primary transfer roller 5 to which the primary transfer bias is applied. With respect to the rotational direction of the photosensitive member 1, a position where the photosensitive member 1 and the intermediary transfer member 10 contact each other and where the toner image is transferred from the photosensitive member 1 onto the intermediary transfer member 10 is the primary transfer position (primary transfer portion) T1. For example, during full-color image formation, toner images of the respective colors of yellow, magenta, cyan and black formed on the photosensitive members 1 are transferred onto the intermediary transfer member 10 at the respective primary transfer portions T1 in a superposition manner. The toner images formed on the intermediary transfer member 10 are transferred (secondary-transferred) onto the recording material S at the secondary transfer portion T2 by the secondary transfer roller 14 to which the secondary transfer bias is applied. The recording material S is sent from a cassette 18 which is an accommodating portion and is fed by a feeding roller pair 17, and then the recording material S is fed to the secondary transfer portion T2 by being synchronized with the toner images on the intermediary transfer member 10 by a registration roller pair 16.

The recording material S on which the toner images are transferred is heated and pressed by the fixing device 15. As a result, the toner images are fixed on the recording material S. Thereafter, the recording material S is discharged to an outside of the image forming apparatus 100, so that a series of image forming processes is ended.

Further, a toner (primary transfer residual toner) remaining on the photosensitive member 1 after the primary transfer step is removed from the photosensitive member 1 by a cleaning blade 71 provided to a cleaning device 7, and is collected in a collecting toner container 72. With respect to the rotational direction of the photosensitive member 1, a position where the cleaning blade 71 contacts the photosensitive member 1 is a cleaning position (cleaning portion) b. Incidentally, a toner (secondary transfer residual toner) remaining on the intermediary transfer member 10 after the secondary transfer step is removed and collected by the intermediary transfer member cleaning device 19.

At least a part of electric charge (residual charges) remaining on the photosensitive member 1 after the primary transfer step is removed by the pre-exposure device 6. With respect to the rotational direction of the photosensitive member 1, a position, on the photosensitive member 1, where the photosensitive member 1 is irradiated with light by the pre-exposure device 6 is a pre-exposure position (pre-exposure portion) c. In this embodiment, the photosensitive member 1 is exposed to light by the pre-exposure device 6 at a position downstream of the primary transfer portion T1 and upstream of the charging portion a (specifically, upstream of the cleaning position b) with respect to the rotational direction of the photosensitive member 1.

2. Transfer Memory

Next, a transfer memory will be described. Incidentally, with respect to each of the plurality of image forming portions P, the case where (secondary transfer in which) the image forming portion P is disposed on the upstream side or the downstream side relatively with respect to the rotational direction of the intermediary transfer member 10 is distinguished in some cases by simply referring to the case (secondary transfer) as "upstream (side)" or "downstream (side)".

On the photosensitive member 1, the toner image is formed by electrical deposition of the toner in an amount determined based on a potential of an electrostatic latent image formed by image exposure. Then, the toner image is electrically transferred onto the intermediary transfer member 10 by the action of a transfer current supplied to primary transfer portion. At this time, a potential difference generates on the photosensitive member 1 by causing the electrostatic latent image to remain on the photosensitive member 1 also after the transfer step, so that a ghost generates in some cases. Here, even in the case where formation of the electrostatic latent image is not effected at one image forming portion P, the toner image formed by the image forming portion P upstream of the one image forming portion P passes through the primary transfer portion T1 of the one image forming portion P, and the potential difference can generate on the photosensitive member 1 of the one image forming portion P. This is a phenomenon generating, when the toner image formed on the upstream (side) image forming portion P passes through the primary transfer portion T1 of the downstream (side) image forming portion P, due to generation of a difference in current flowing from the primary transfer roller 5 to the photosensitive member 1 of the downstream image forming portion P between a portion where the toner exists (hereinafter referred to as a "toner portion") and a portion where the toner does not exist (hereinafter referred to as a "non-toner portion"). As described above, this phenomenon is called the "transfer memory", and causes a multi-color ghost.

Figure 4:
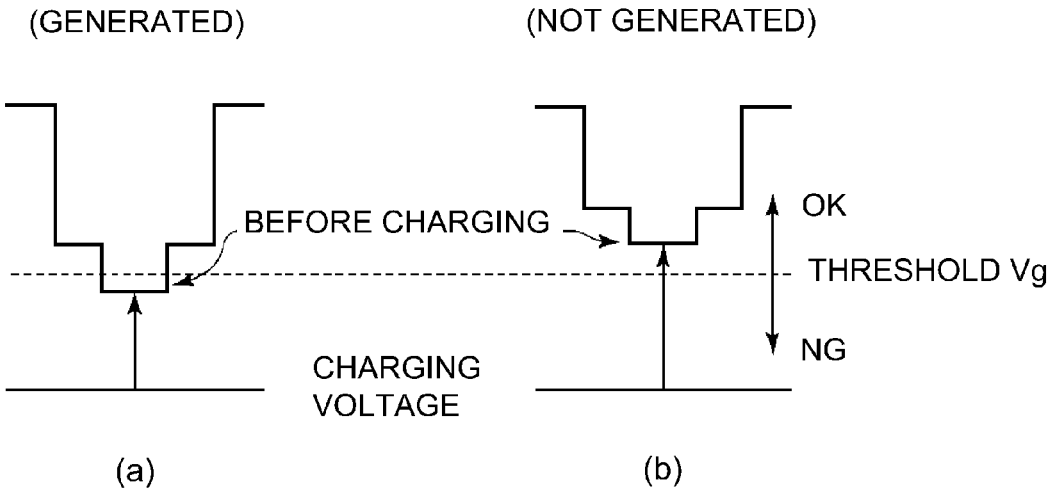
In FIG. 4, (a) and (b) are schematic views for illustrating a surface potential of a photosensitive member.

In FIG. 4, (a) and (b) are schematic views each showing a surface potential of the photosensitive member 1 of the downstream image forming portion P after the toner image from the upstream image forming portion P passes through the primary transfer portion T1 of the downstream image forming portion P. In (a) and (b) of FIG. 4, the surface potential of the photosensitive member 1 is positive (+) on an upper side and is negative (−) on a lower side.

In general, in normal use of the image forming apparatus 100, setting of the current flowing from the primary transfer roller 5 into the photosensitive member 1 is made in order not to generate the multi-color ghost. However, in the case where the image forming apparatus 100 is used under a condition such that a current causing discharge to the intermediary transfer member 10 is excessively large, dielectric breakdown of the intermediary transfer member 10 quickly progresses, so that there is a possibility that an electric resistance of the intermediary transfer member 10 lowers more than expected. When the electric resistance of the intermediary transfer member 10 lowers, the current flowing from the primary transfer roller 5 into the surface of the photosensitive member 1 is insufficient. For that reason, a potential difference between the surface potential of the photosensitive member 1 after passing through the primary transfer portion T1 and before passing through the charging portion a (hereinafter simply referred to as "before passing through charging portion" and the voltage applied to the charging roller 2 (hereinafter, this potential difference is simply referred to as a "contrast") cannot be maintained. As a result, the potential difference generating on the photosensitive member 1 between the toner portion and the non-toner portion cannot be eliminated and results in the transfer memory, so that the multi-color ghost is caused in some cases. An amount of a lowering in contrast can be replenished by removing the electric charges on the photosensitive member 1 before passing through charging portion by the pre-exposure device 6. However, when an exposure amount of the photosensitive member 1 by the pre-exposure device 6 (hereinafter also referred to as a "pre-exposure amount") is made large more than necessary, in some cases, promotion of abrasion of the photosensitive member 1 due to an increase in current flowing into the photosensitive member 1 at the charging portion a and promotion of deterioration of the photosensitive member 1 due to continuous light irradiation are caused.

On the other hand, for example, it would be considered that a potential sensor for detecting the surface potential of the photosensitive member 1 before passing through charging portion is provided and on the basis of a detection result thereof, the pre-exposure amount is controlled, but as described above, there is a problem in terms of the space and the cost.

Therefore, in this embodiment, as described below in detail, a charging current is detected and the photosensitive member 1 can be sufficiently discharged while minimizing the pre-exposure amount.

3. Principal of Pre-Exposure Amount Adjusting Control

Next, a principle of pre-exposure amount adjusting control for suppressing not only the multi-color ghost due to the transfer memory but also the deterioration of the photosensitive member 1 will be described.

First, the following experiment was conducted. A red solid image formed at the YM image forming portions PY, PM is sent to the primary transfer portion T1 of the C image forming portion PC where only the charging process of the photosensitive member 1 is effected but formation of the electrostatic latent image is not effected. Then, the surface potential of a region (toner portion, red solid image portion) contacting the primary transfer portion T1 on the photosensitive member 1 of this C image forming portion PC is measured by a surface electrometer. Next, the surface potential of the non-toner portion before passing through charging portion on the photosensitive member 1 of the C image forming portion PC in the case where image formation is not effected at the YM image forming portions PY, PM is measured. Here, the red solid image was formed over an entire area of an image forming region (toner image formable region) with respect to a longitudinal direction (rotational axis direction) of the photosensitive member 1. In this embodiment, in the case where a test image for detecting the charging current is not particularly referred to, the test image is a solid image formed over the entire region of the image forming region with respect to the longitudinal direction of the photosensitive member 1.

Incidentally, the surface electrometer described above is provided downstream of the primary transfer portion T1 and upstream of the charging portion a with respect to the rotational direction of the photosensitive member 1 for this experiment, but is not intended to be provided for effecting control using the surface electrometer in the image forming apparatus 100 in this embodiment. More specifically, the surface electrometer was disposed so as to measure the surface potential of the photosensitive member 1 at a position downstream of the pre-exposure portion c and upstream of the charging portion a with respect to the rotational direction of the photosensitive member 1. Further, measurement of the respective surface potentials was made while effecting the pre-exposure at a predetermined pre-exposure amount (initial set value) by the pre-exposure device 6.

For example, in the case where the photosensitive member 1 of the C image forming portion PC was charged substantially uniformly to −600 V by the charging roller 2, the surface potential of the red solid image portion before passing through charging portion on the photosensitive member 1 was −200 V, and the surface potential of the non-toner portion before passing through charging portion was −150 V. In this way, it is understood that due to the images formed at the upstream YM image forming portions PY, PM, the potential difference constituting a factor of the ghost generates at the C image forming portion PC. At this time, a total current flowing from the primary transfer roller 5 into the photosensitive member 1 in an entire region of the photosensitive member 1 with respect to the longitudinal direction at the C image forming portion PC (hereinafter, this current is also referred to as a "transfer current") is about 25 μA. In this case, even when the potential difference generated, the ghost did not generate on a subsequent image. This would be considered because a sufficient contrast is maintained between the surface potential of the photosensitive member 1 before passing through charging portion and the voltage applied to the charging roller 2 ((b) of FIG. 4).

A similar experiment was conducted in a secondary transfer in which the total current (transfer current) flowing from the primary transfer roller 5 into the photosensitive member 1 at the C image forming portion PC was adjusted to about 15 μA.

In this case, the surface potential of the red solid image portion before passing through charging portion on the photosensitive member 1 at the C image forming portion PC was −400 V, and the surface potential of the non-toner portion before passing through charging portion was −350 V. The images sent from the upstream YM image forming portions PY, PM to the primary transfer portion of the C image forming portion PC are similar to those in the above-described experiment, and therefore the difference in surface potential of the photosensitive member 1 before passing through charging portion between the toner portion and the non-toner portion is the same, i.e., 50 V. However, the ghost generated on a subsequent image. This would be considered because a sufficient contrast is not maintained between the surface potential of the photosensitive member 1 before passing through charging portion and the voltage applied to the charging roller 2 ((a) of FIG. 4).

Next, a relationship between the charging current (charging DC current) and the ghost will be described. When the region of the photosensitive member 1 charged substantially uniformly to the charge potential Vd by the charging roller 2 passes through the primary transfer portion T1, the region is subjected to discharge from the transfer means, so that the surface potential is changed to a surface potential Vt, before passing through charging portion. In the above-described experiment, when the transfer current is 25 μA, Vt1 is −200 V, and when the transfer current is 15 μA, Vt2 is −400 V. A contrast ΔV when the photosensitive member 1 is charged again substantially uniformly to the charge potential Vd by the charging roller 2 while maintaining the potential is $\Delta V=|Vd-Vt|$.

A value of a charging current Idc is represented by the following formula 1.

$$Idc=\in\times\in 0\times L\times v\times\Delta V/d \quad \text{(formula 1)}$$

In the formula 1, ΔV (in the above-described experiment, $\Delta V=|Vd-Vti|$, i=1, 2) is a contrast during the charging process. Further, in the formula 1, L(m) is a length of the photosensitive member 1 with respect to the longitudinal direction, V(m/s) is a peripheral speed of the photosensitive member 1, d(m) is a film thickness of the photosensitive member 1, ∈ is relative dielectric constant, and ∈0 is vacuum dielectric constant.

Here, the longitudinal length L and the peripheral speed v of the photosensitive member 1 are predetermined values, and a value of the film thickness d of the photosensitive member 1 can be calculated substantially accurately from, e.g., a charging time and a traveling time. In this embodiment, by the above formula 1, a relationship between a charging current Idc(1) when the transfer current is 25 μA and a charging current Idc(2) when the transfer current is 15 μA can be presented by Idc(1)=2×Idc(2).

In this way, an amount of a fluctuation of the surface potential of the red solid image portion on the photosensitive member 1 before passing through charging portion when the transfer current changes can be predicted by detecting the charging current. There is a proportional relationship between the charging current Idc and the contrast ΔV. For that reason, when the charging current Idc decreases, also the contrast ΔV decreases, but the charge potential Vd of the photosensitive member 1 is constant, and therefore a surface potential Vti before passing through charging portion decreases (increases in absolute value). Further, when the absolute value of the surface potential Vti before passing through charging portion exceeds a certain potential, a necessary minimum contrast ΔV cannot be maintained, so that the multi-color ghost generates ((a) of FIG. 1). Here, the certain potential at which the ghost generates is referred to as a ghost generation threshold Vg.

Therefore, in this embodiment, a detection of the charging current is fed back to a pre-exposure amount by the pre-exposure device 6, so that the surface potential Vti of the photosensitive member 1 before passing through charging portion is controlled. As a result, a necessary contrast ΔV is maintained, so that it becomes possible to suppress the ghost at a necessary minimum pre-exposure amount.

Incidentally, in this embodiment, on the basis of a charging current detected by the ammeter 23 when a region (toner portion) of the photosensitive member 1 contacting a test toner image at the primary transfer portion T1 is electrically charged (i.e., when the toner portion passes through the charging portion a), the surface potential before passing through charging portion is obtained from the above-described relational expression. Then, the pre-exposure amount is adjusted so as to become large in the case where an absolute value of the surface potential before passing through charging portion exceeds an absolute value of the ghost generation threshold Vg. However, the adjustment of the pre-exposure amount is not limited thereto, but the pre-exposure amount may only be required to be adjusted so as to become large in the case where an absolute value of the charging current detected by the ammeter 23 when the toner portion is subjected to the charging process is smaller than a predetermined threshold set in advance.

Further, as described above, when the transfer current changes, the charging current changes. For that reason, in the case where setting of the primary transfer bias (target value of the voltage) is variable, depending on the setting of the primary transfer bias, the threshold can be set at a plurality of values. The primary transfer bias is changed in some cases depending on an environment or a use (operation) secondary transfer (such as information on an amount of use from an initial stage of use) of the intermediary transfer member or the primary transfer roller. Further, as is understood from the above-described relational expression, when the charge potential of the photosensitive member 1 changes, the charging current changes. For that reason, in the case where the setting of the charge potential of the photosensitive member 1 is variable, depending on the setting of the charge potential, the threshold described above can be set at a plurality of values.

Further, a degree of the increase in pre-exposure amount can be appropriately set so that the multi-color ghost due to the transfer memory can be sufficiently suppressed. Further, the pre-exposure amount may also be set so that the pre-exposure amount before adjustment is 0 (i.e., the pre-exposure device 6 is turned off) and the pre-exposure amount is made larger than 0 after the adjustment (i.e., the pre-exposure device 6 is turned on). Further, in this embodiment, in order to suppress the multi-color ghost due to the transfer memory which is liable to generate when the electric resistance of the intermediary transfer member 10 lowers more than allowed, the pre-exposure amount is changed from a relatively small value to a relatively large value with the threshold as a boundary. However, the change in pre-exposure amount is not limited thereto, but the pre-exposure amount may also be made large stepwisely every decrease in detected current value in such a manner that a plurality of thresholds stepwisely increasing in absolute value are provided and the detected current value is smaller than an associated threshold. Further, a desired pre-exposure amount correspondingly to the detected current value is checked and stored in a table, and then depending on the detected current value, the pre-exposure amount may also be continuously changed.

4. Control Mode

Figure 5:
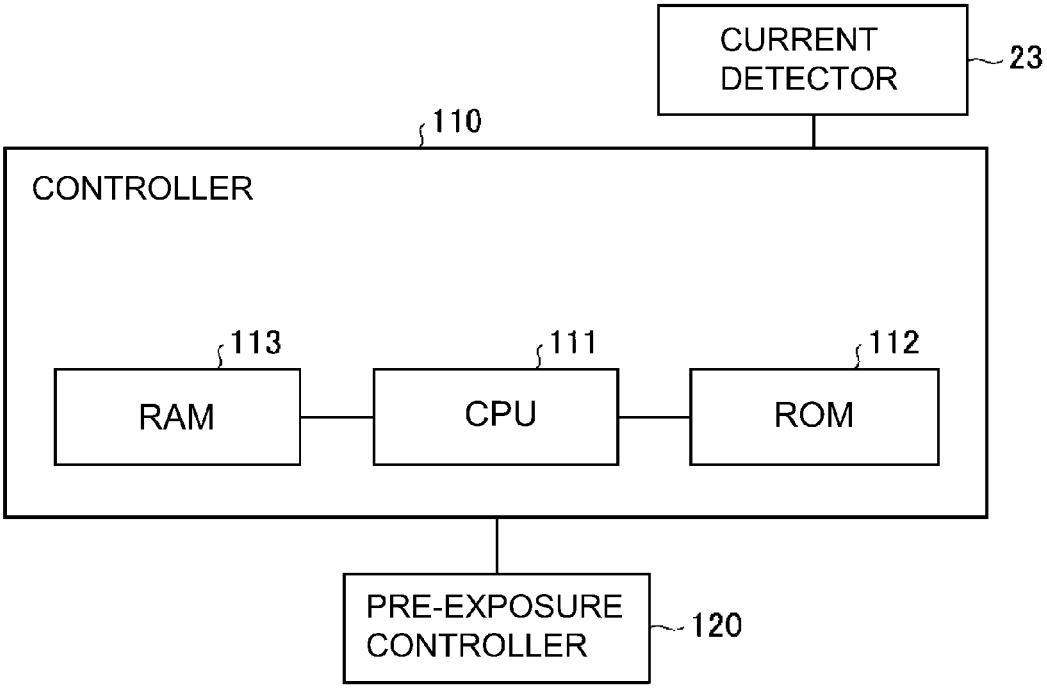
FIG. 5 is a block diagram showing a control mode of a principal part of the image forming apparatus.

FIG. 5 is a block diagram showing a schematic control mode of a principal part of the image forming apparatus 100 in this embodiment. In the image forming apparatus 100, a controller 110 as a control means for effecting integrated control of respective portions of the image forming apparatus 100 is provided. The controller 110 is constituted by including CPU 111 which is a central element for performing computation and ROM 112, RAM 113 and the like which are storing elements (memories) as storing means. In the RAM 113, a detection result of the sensor and a computation result and the like are stored, and in the ROM 112, a control program and a preliminarily obtained data table and the like are stored. In this embodiment, the ammeter (current detecting circuit) 23, a pre-exposure amount control circuit 120 and the like are connected with the controller 110. Further, the controller 110 effects control (pre-exposure amount adjusting control) for adjusting the pre-exposure amount of the pre-exposure device 6 by controlling the pre-exposure amount control circuit 120 on the basis of a charging current detection result by the ammeter 23. In this embodiment, the controller 110 has a function of a calculating portion (detecting portion of the multi-color ghost due to the transfer memory) for calculating the surface potential of the photosensitive member 1 before passing through charging portion, and constitutes an adjusting portion for adjusting the pre-exposure amount by executing the pre-exposure amount adjusting control.

In this embodiment, the controller 110 causes the pre-exposure amount control circuit 120 to set the pre-exposure amount, so that the pre-exposure device 6 emits light at a predetermined light quantity. The pre-exposure amount control circuit 120 is capable of controlling a current (pre-exposure current, driving current) supplied to the pre-exposure device 6 in a range, e.g., from 0 mA (minimum) to 20 mA (maximum) by PWM control. There is a substantially linear relationship between the pre-exposure current and the pre-exposure amount, and there is a substantially linear relationship between the pre-exposure current and a pre-exposure duty (PWM duty). That is, the pre-exposure current is 0 mA at the pre-exposure duty of 0% and is 20 mA at the pre-exposure duty of 100%.

Here, the image forming apparatus 100 performs a "job" which is a series of image output operations, started by a single start instruction, for forming and outputting images on a single recording material S or a plurality of recording materials S. The job includes, in general, an image forming step (printing step), a pre-rotation step, a sheet (paper) interval step in the case where the images are formed on the plurality of recording materials S, and a post-rotation step. The image forming step refers to a period in which electrostatic latent image formation, toner image formation and toner image transfer which are effected for actually forming and outputting the images on the plurality of recording materials S are carried out, and during image formation refers to this period. The pre-rotation step refers to a period, from input of the start instruction until the image formation is actually started, in which a preparatory operation before an image forming step is performed. The sheet interval step refers to a period corresponding to an interval between a recording material S and subsequent recording material S when continuous image formation for continuously forming the images on the plurality of recording materials S is effected. The post-rotation step refers to a period in which a post-operation (preparatory operation) is performed after the image forming step. During non-image formation refers to a period other than during image formation, and includes the post-rotation step, the sheet interval step and the post-rotation step, which are described above, and further includes a pre-multi-rotation step in which a preparatory operation during turning-on of a power source of the image forming apparatus 100 or during restoration from a sleep secondary transfer is performed, and the like step.

In this embodiment, every time when the number of times of image formation as information on an amount of use of the intermediary transfer member 10 is not less than a predetermined threshold, the pre-exposure amount adjusting control is effected in the post-rotation step of the job. However, the timing of the pre-exposure amount adjusting control is not limited thereto, but the pre-exposure amount adjusting control may also be carried out at arbitrary timing during the non-image formation.

5. Pre-Exposure Amount Adjusting Control

Figure 6:
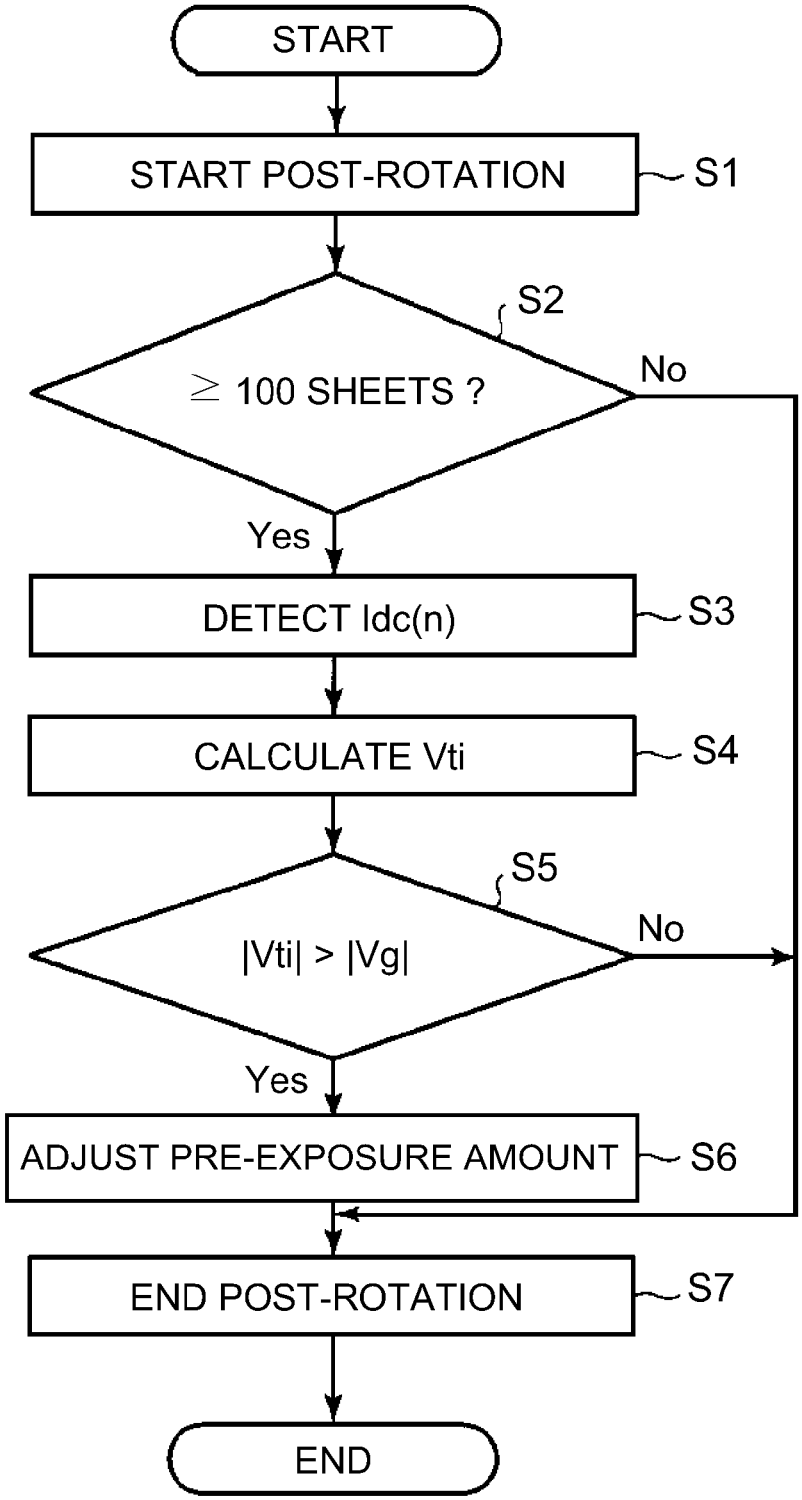
FIG. 6 is a flowchart of pre-exposure amount adjusting control.

Next, the pre-exposure amount adjusting control (ghost detecting operation) in this embodiment will be described. FIG. 6 is a flowchart showing a procedure of the pre-exposure amount adjusting control in this embodiment. As an example, the procedure of the pre-exposure amount adjusting control at the C image forming portion PC will be described.

When the post-rotation step at the time of an end of the job is started (S1), the CPU 111 discriminates whether or not image formation of 100 sheets (e.g., as an A4-size conversion value) or more is effected from the last pre-exposure amount adjusting control (S2).

In S2, in the case where discrimination that the image formation of 100 sheets or more is effected is made, the CPU 111 starts an operation in which a test toner image is formed and then the charging current is detected (S3). In this step, as the test toner image, a red solid image is formed on the intermediary transfer member 10 by the YM image forming portions PY, PM, and then is sent into the primary transfer portion T1 of the C image forming portion PC. Then, at the C image forming portion PC, a charging current Idc(n) when a region (toner portion) contacting the red solid image on the photosensitive member 1 at the primary transfer portion T1 is charged (i.e., when the toner portion passes through the charging portion a) is detected by the ammeter 23. At this time, the pre-exposure device 6 is driven at a current pre-exposure amount setting.

Next, the CPU 111 calculates the surface potential Vti before passing through charging portion from the above-described relational expression on the basis of Idc(n) detected by the ammeter 23, and then stores the calculated Idc(n) in the RAM 113 (S4).

Next, the CPU 111 compares an absolute value of the calculated surface potential Vti before passing through charging portion with an absolute value of the ghost generation threshold Vg stored in advance in the RAM 112 (S5). In the case where the absolute values are discriminated as being $|Vt1|>|Vg|$, the CPU 111 provides an instruction to feed back the pre-exposure amount to the pre-exposure device 6 (S6). Specifically, in this embodiment, a setting of a driving current of the pre-exposure device 6 in the pre-exposure amount control circuit 120 is made large so that the pre-exposure amount is made larger than the pre-exposure amount before adjustment. Thereafter, when a predetermined operation in the post-rotation step is ended, the job is ended (S7).

Incidentally, in the above, the case where the red solid image was formed as the test toner image and then the pre-exposure amount at the C image forming portion PC was adjusted was described as an example. In the image forming apparatus 100 in this embodiment, also at the K image forming portion PK, similarly as at the C image forming portion PC, the multi-color ghost is liable to generate. Accordingly, in this embodiment, similarly as at the C image forming portion PC, as the test toner image, a red solid image (which was formed for the pre-exposure amount adjusting control at the C image forming portion PC or which is newly formed separately) is used. However, the test toner image is not limited thereto, i.e., is not limited to the red solid image, but may also be a green solid image. Further, although compared with the secondary color image, the decrease in surface potential (increase in absolute value of the surface potential) of the photosensitive member 1 before passing through charging portion is slight and thus the ghost does not readily generate, detection of the charging current similar to the above-described charging current detection may also be made at the downstream image forming portion P by using a single-color image of yellow or magenta as the test toner image. That is, the pre-exposure amount adjusting control in this embodiment is applicable to adjustment of the pre-exposure amount by the pre-exposure device 6 provided correspondingly to the photosensitive member 1 positioned downstream of the upstreammost photosensitive member 1, of the plurality of photosensitive members 1, with respect to the rotational direction of the intermediary transfer member 10.

Further, in the case where the solid image (particularly the multi-color solid image) is formed at the upstream image forming portion P, the ghost due to the transfer memory is liable to generate at the downstream image forming portion P, and therefore in order to predict this ghost generation, it is preferable that a solid image (a toner image at a maximum density level) is used as the test toner image. However, a toner amount of the test toner image may only be required to be not less than a predetermined amount with which there is a possibility that the ghost due to the transfer memory is generated, so that the test toner image may also be a half-tone image as desired.

6. Effect

Figure 7:
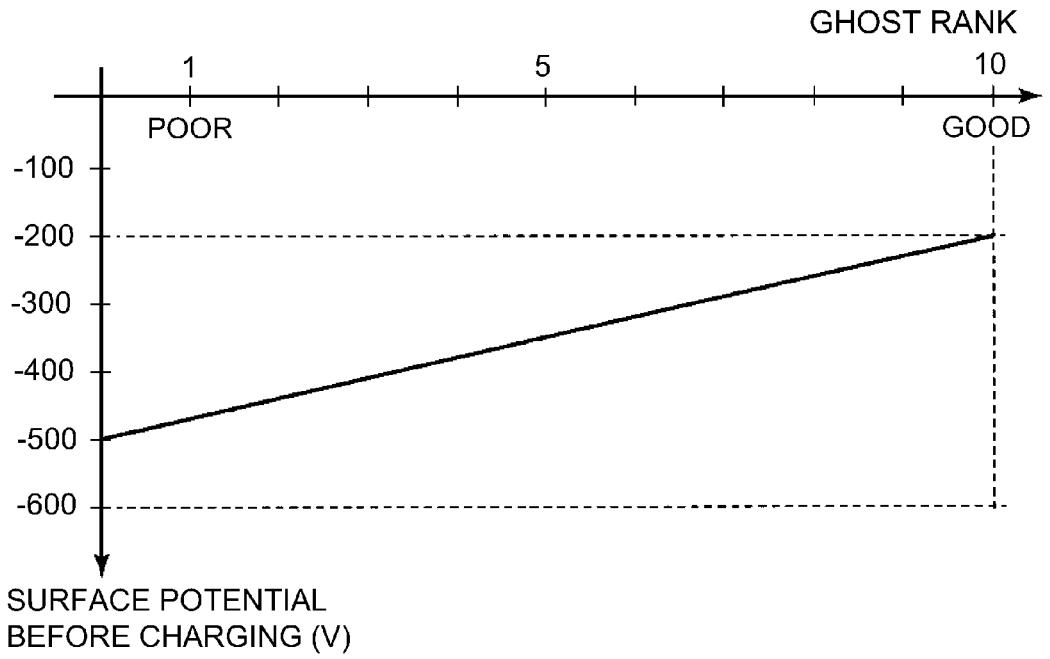
FIG. 7 is a graph showing a correlation between a surface potential of a photosensitive member before passing through a charging portion and a ghost level.

FIG. 7 is a graph showing a correlation between the surface potential of the toner portion (red solid image) before passing through charging portion on the photosensitive member 1 of the C image forming portion PC and a ghost level (rank). Incidentally, similarly as described above, the surface potential before passing through charging portion is the potential after the pre-exposure by the pre-exposure device 6 is effected. Further, FIG. 8 is a graph showing a correlation between the surface potential detected by the ammeter 23 and the surface potential of the photosensitive member 1 before passing through charging portion.

Figure 8:
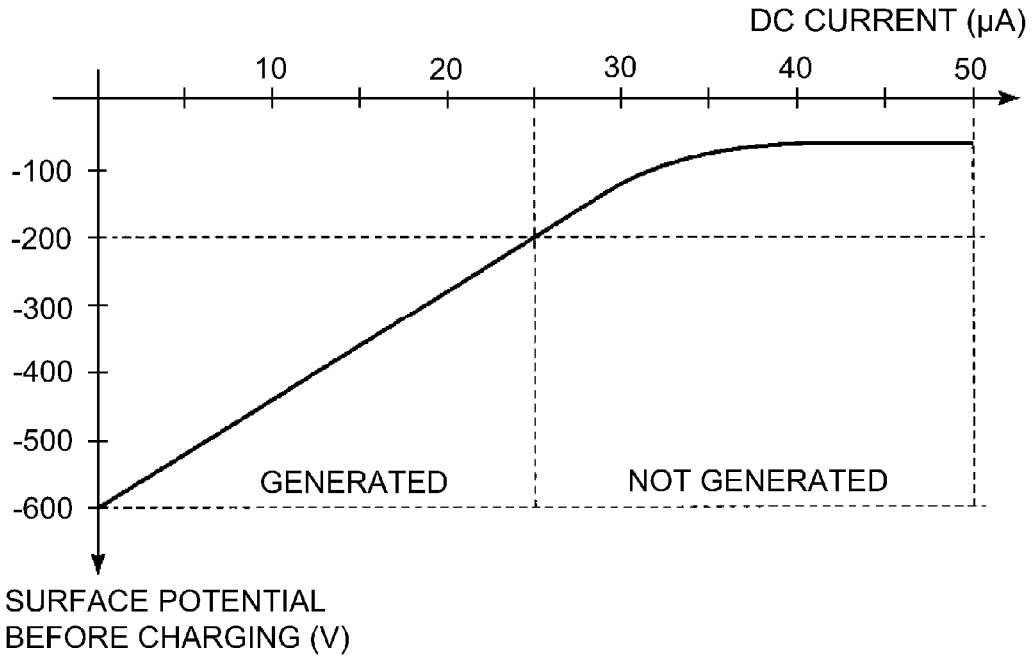
FIG. 8 is a graph showing a correlation between a charging current and the surface potential of the photosensitive member before passing through the charging portion.

From the relationships shown in FIGS. 7 and 8 derived from the experiment, it is understood that the charging current is smaller than a certain threshold and the surface potential Vti of the photosensitive member 1 before passing through charging portion exceeds the ghost generation threshold Vg and thus the ghost due to the transfer memory is liable to generate. On the other hand, in this embodiment, a generation level of the ghost due to the transfer memory is predicted by detecting the charging current and is fed back to the pre-exposure amount by the pre-exposure device 6. Specifically, in the case where the absolute value of the charging current is smaller than a predetermined threshold (also in the case where the surface potential, before passing through charging portion, obtained on the basis of the charging current exceeds a predetermined threshold), the pre-exposure amount is adjusted so as to become large. As a result, it becomes possible to suppress the generation of the ghost due to the transfer memory.

As described above, the image forming apparatus 100 in this embodiment includes the pre-exposure device 6 for exposing the photosensitive member 1 to light at the position downstream of the transfer position T1 and upstream of the charging position a with respect to the rotational direction of the photosensitive member 1. This image forming apparatus 100 is capable of transferring the toner image from the photosensitive member 1 onto the transfer member 10 in superposition on the toner image fed to the transfer position T1 while carrying the toner image on the transfer member 10. Further, the image forming apparatus 100 includes the detecting portion 23 for detecting the DC current passing through the charging member 2 when the voltage is applied from the voltage source D3 to the charging member 2, and the test toner image forming means for forming a predetermined test toner image on the transfer member 10. The image forming apparatus 100 further includes the adjusting portion 110 for adjusting the exposure amount of the photosensitive member 1 by the pre-exposure device 6 on the basis of the detection result of the detecting portion 23. The detection result of the detecting portion 23 is a detection result of the detecting portion 23 when the region on the photosensitive member 1 contacting, in the secondary transfer in which the transfer current is supplied, the test toner image which is carried and fed to the transfer position T1 by the transfer member 10 is charged by the charging member 2. Particularly, in this embodiment, the test toner image forming means is constituted by including another photosensitive member 1, on which the toner image transferred onto the transfer member 10 is to be formed, disposed upstream of the above-described photosensitive member 1 with respect to the movement direction of the transfer member 10. Further, the test toner image is formed on this another photosensitive member 1 and is transferred from this another photosensitive member 1 onto the transfer member and then is fed to the transfer position T1. Further, in this embodiment, in the case where the current detected by the detecting portion 23 is smaller than a predetermined threshold, the adjusting portion 110 adjusts the exposure amount of the photosensitive member 1 by the pre-exposure device 6 so as to be larger than the exposure amount before the adjustment.

As described above, in this embodiment, the test toner image is formed on the intermediary transfer member 10 at the upstream image forming portion and the charging current (charging DC current) when the region (toner portion) contacting the test toner image on the photosensitive member 1 at the downstream image forming portion passes through the charging portion a is detected. In the case where the charging current determined by the contrast between the surface potential of the photosensitive member 1 before passing through charging portion and the potential of the charging bias applied to the charging roller 2 is small, a potential convergence property during the charging lowers and cannot eliminate the potential difference capable of generating the ghost, so that the ghost generates in some cases. For that reason, in the case where the absolute value of the detected charging current is smaller than the predetermined threshold, the pre-exposure amount is adjusted so as to become large, so that the absolute value of the surface potential of the photosensitive member 1 before passing through charging portion can be made small. As a result, for example, it is possible to suppress the ghost, such as the multi-color ghost, due to the transfer memory in a necessary and sufficient manner without providing the surface potential sensor, e.g., at a place close to the photosensitive member 1 and without impairing advantages such as space saving, cost reduction and the like. Accordingly, according to this embodiment, in the constitution in which the photosensitive member 1 is irradiated with light and the ghost due to the transfer memory is suppressed, it is possible to suppress the exposure of the photosensitive member 1 to light more than necessary without impairing the advantages such as the space saving.

[Other Embodiments]

The present invention was described above based on the specific embodiment, but is not limited to the above-described embodiment.

For example, in the above-described embodiment, the case where the charging member contacted the photosensitive member was described, but the present invention is not limited thereto. A problem of the ghost, such as the multi-color ghost, due to the transfer memory is a common problem irrespective of the charging type such as a non-contact charging type or a proximity charging type. Accordingly, the charging member such as the charging roller is not necessarily contacted to the surface of the photosensitive member as a member-to-be-charged, but if electric discharge at a close portion can be made, the charging member may also be disposed in non-contact with and close to the photosensitive member with a gap (spacing) of, e.g., several 10 μm. In this way, the present invention is applicable to also a constitution in which the charging member is disposed close to the photosensitive member and in which the photosensitive member is electric charged by the electric discharge at the close portion (correspond to gaps upstream and downstream of the contact portion between the charging roller and the photosensitive member in the above-described embodiment).

Further, in the above-described embodiment, the case where the AC charging type in which the oscillating voltage in the form of the DC voltage biased with the AC voltage was used as the charging bias was employed, but the present invention is not limited thereto. The problem of the ghost, such as the multi-color ghost, due to the transfer memory tends to generate more conspicuously in the DC charging type in which the potential convergence property of the photosensitive member is lower than that in the AC charging type and in which the charging bias consisting only of the DC voltage is used. For that reason, by applying the present invention to the constitution, a higher effect is achieved. Incidentally, in the case where the DC charging type is employed, the film thickness of the photosensitive member decreases during continuous image formation, so that electric discharge start voltage lowers. In the case where a certain voltage is continuously applied, the surface potential increases depending on a degree of the decrease in film thickness, and therefore it is desirable that applied voltage control depending on the film thickness of the photosensitive member is effected.

Further, in the above-described embodiment, the tandem-type image forming apparatus was described as the example, but the present invention is also applicable to an image forming apparatus of a so-called one-drum type. In the image forming apparatus of the one-drum type, a plurality of developing devices are provided for a single photosensitive member and electrostatic latent images, of respective color components, successively formed on the photosensitive member are successively developed using the developing devices in a switching manner. Then, for every formation of the toner image of an associated color on the photosensitive member, the toner image is primary-transferred superposedly from the photosensitive member onto an intermediary transfer member at an associated primary transfer portion. The intermediary transfer member repetitively passes through the primary transfer portions while carrying thereon the transferred toner images. Then, finally formed multiple-toner images are secondary-transferred onto a recording material at a secondary transfer portion. Also in such an image forming apparatus, with respect to primary transfer steps for the second color and subsequent colors, similarly as in the image forming apparatus in the above-described embodiment, the problem of the ghost, such as the multi-color ghost, due to the transfer memory can generate. Accordingly, also in such an image forming apparatus, a test toner image is formed on the intermediary transfer member and is fed again to the primary transfer portion and thus a charging current when a region on the photosensitive member contacting the test toner image is charged can be detected. Then, on the basis of a detection result of the charging current, the exposure amount of the photosensitive member by the pre-exposure device can be adjusted similarly as in the above-described embodiment, so that an effect similar to the effect of the above-described embodiment can be achieved. Also in this case, the above-described test toner image forming means is constituted by including the photosensitive member itself subjected to the pre-exposure process by the pre-exposure device 6 as an object-to-be-adjusted. In this case, the test toner image is formed on the photosensitive member and is transferred from the photosensitive member onto the transfer member at the transfer position, and then is fed again to the transfer position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-100488 filed on May 15, 2015, which is hereby incorporated by reference herein in its entirety.

What is claimed is:

1. An image forming apparatus comprising:

a rotatable intermediary transfer member for carrying a toner image to be transferred onto a recording material;

a first image forming portion including a rotatable first photosensitive member, a first charging member for electrostatically charging said first photosensitive member, a first developing device for developing an electrostatic latent image formed on a charged surface charged by said first charging member, a first transfer portion for transferring a toner image onto said intermediary transfer member, and a first pre-exposure device for exposing to light said first photosensitive member at a position downstream of said first transfer portion and upstream of said first charging member with respect to a rotational direction of said first photosensitive member;

a second image forming portion including a rotatable second photosensitive member, a second charging member for electrostatically charging said second photosensitive member, a second developing device for developing an electrostatic latent image formed on a charged surface charged by said second charging member, a second transfer portion for transferring a toner image onto said intermediary transfer member, and a second pre-exposure device for exposing to light said second photosensitive member at a position downstream of said second transfer portion and upstream of said second charging member with respect to a rotational direction of said second photosensitive member, wherein said second image forming portion is positioned upstream of said first image forming portion with respect to a movement direction of said intermediary transfer member;

a detecting portion for detecting a current flowing through said first charging member when a predetermined voltage is applied to said first charging member; and an adjusting portion for adjusting an exposure amount of said first photosensitive member by said first pre-exposure device on the basis of a detection result of said detecting portion in a region on said first photosensitive member having contacted a toner band formed in a maximum amount per unit area on said intermediary transfer member by said second image forming portion in a state in which a transfer current is supplied to said first transfer portion.

2. An image forming apparatus according to claim 1, wherein said adjusting portion adjusts the exposure amount of said second photosensitive member by said second pre-exposure device when the current detected by said detecting portion is smaller than a predetermined threshold.

3. An image forming apparatus according to claim 1, wherein each of said first and second charging members electrostatically charges an associated one of said first and second photosensitive members.

4. An image forming apparatus comprising:

a rotatable intermediary transfer member for carrying a toner image to be transferred onto a recording material;

a first image forming portion including a rotatable first photosensitive member, a first charging member for electrostatically charging said first photosensitive member, a first developing device for developing an electrostatic latent image formed on a charged surface charged by said first charging member, a first transfer portion for transferring a toner image onto said intermediary transfer member, and a first pre-exposure device for exposing to light said first photosensitive member at a position downstream of said first transfer portion and upstream of said first charging member with respect to a rotational direction of said first photosensitive member;

a second image forming portion including a rotatable second photosensitive member, a second charging member for electrostatically charging said second photosensitive member, a second developing device for developing an electrostatic latent image formed on a charged surface charged by said second charging member, a second transfer portion for transferring a toner image onto said intermediary transfer member, and a second pre-exposure device for exposing to light said second photosensitive member at a position downstream of said second transfer portion and upstream of said second charging member with respect to a rotational direction of said second photosensitive member, wherein said second image forming portion is positioned upstream of said first image forming portion with respect to a movement direction of said intermediary transfer member;

a third image forming portion including a rotatable third photosensitive member, a third charging member for electrostatically charging said third photosensitive member, a third developing device for developing an electrostatic latent image formed on a charged surface charged by said third charging member, a third transfer portion for transferring a toner image onto said intermediary transfer member, and a third pre-exposure device for exposing to light said third photosensitive member at a position downstream of said third transfer portion and upstream of said third charging member with respect to a rotational direction of said third photosensitive member, wherein said third image forming portion is positioned upstream of said second image forming portion with respect to a movement direction of said intermediary transfer member;

a detecting portion for detecting a current flowing through said first charging member when a predetermined voltage is applied to said first charging member; and an adjusting portion for adjusting an exposure amount of said first photosensitive member by said first pre-exposure device on the basis of a detection result of said detecting portion in a region on said first photosensitive member having contacted an image formed in a maximum amount per unit area on said intermediary transfer member by said second and third image forming portions in a state in which a transfer current is supplied to said first transfer portion.

5. An image forming apparatus according to claim 4, wherein said adjusting portion adjusts the exposure amount of said third photosensitive member by said third pre-exposure device when the current detected by said detecting portion is smaller than a predetermined threshold.

6. An image forming apparatus according to claim 4, wherein each of said first to third charging members electrostatically charges an associated one of said first to third photosensitive members.

* * * * *